United States Patent [19]

Spickofsky

[11] 3,994,032

[45] Nov. 30, 1976

[54] DRAIN CLEARING BELLOWS

[75] Inventor: William Paul Spickofsky, San Francisco, Calif.

[73] Assignee: Lawrence Peska Associates, Inc., New York, N.Y.

[22] Filed: Aug. 20, 1975

[21] Appl. No.: 606,205

[52] U.S. Cl. ..... 4/255; 92/35; 417/472

[51] Int. Cl.[2] ..... E03D 5/09

[58] Field of Search ..... 4/10, 255–257; 134/166 C; 15/104.04; 92/34, 35, 37; 417/472, 473

[56] References Cited

UNITED STATES PATENTS

| | | | |
|---|---|---|---|
| 2,686,006 | 8/1954 | Hasselquist | 417/472 X |
| 3,301,293 | 1/1967 | Santelli | 92/35 X |
| 3,644,943 | 2/1972 | Leonardo | 4/255 |
| 3,875,941 | 4/1975 | Adair | 417/472 X |

FOREIGN PATENTS OR APPLICATIONS

| | | | |
|---|---|---|---|
| 503,745 | 6/1920 | France | 4/255 |
| 288,586 | 9/1931 | Italy | 4/255 |

*Primary Examiner*—Harry N. Haroian
*Assistant Examiner*—Stuart S. Levy
*Attorney, Agent, or Firm*—Jack D. Slobod

[57] ABSTRACT

A collapsable bellows for applying pressure to clear a sink drain is generally an elongated tubular thin-walled rubber or resilient plastic member having a mouth and flange at one end and a closure wall at the other end. The sidewall of the member has a series of accordian pleats along its length, which are formed by alternate frusto-conical and annular wall sections. An integral mushroom-shaped handle projects from the exterior of the closure wall.

1 Claim, 2 Drawing Figures

DRAIN CLEARING BELLOWS

FIELD OF THE INVENTION

The present invention relates generally to plunger devices for manual application of air pressure over a drain. In its particular aspects, the present invention relates to an elongated tubular bellows device which may be proportioned for clearing a sink drain.

BACKGROUND OF THE INVENTION

Heretofore, large generally semi-spherical shaped plungers have been known for clearing clogged toilets and drains. It has not been possible to my knowledge to provide a small plunger proportioned for clearing a sink drain, because the small volume of air trapped within such a small plunger has not been sufficient to unclog the drain. Further, previous plunger devices have been difficult to store because of their awkward size and shape.

OBJECTS OF THE INVENTION

It is an object of the present invention to provide a plunger type device proportioned for operation on a sink drain, which holds sufficient air to unclog the drain.

It is a further object of the present invention to provide a plunger type device which is collapsable so as to be easily stored.

SUMMARY OF THE INVENTION

Briefly, the aforementioned and other objects of the present invention are satisfied by providing an elongated tubular flexible bellows device which has a diameter only slightly larger than the usual sink drain opening. The bellows device has a mouth at one end for fitting over the drain and a closure wall at the opposite end. A series of accordian pleats are spaced along the length of the device to provide for longitudinal collapse or extension.

Due to the elongated shape of the device, sufficient air may be captured within the extended bellows device for unclogging the drain. The device is compressable to an easily stored shape.

To maintain the various pleat sections in coaxial alignment, the pleats are formed by alternate coaxial frusto-conical and annular wall sections.

A mushroom-shaped handle member projects integrally from the closure wall to permit manual application of a reciprocating vertical motion to the top of the bellows device.

Other objects, features and advantages of the present invention will become apparent upon perusal of the following detailed description of the preferred embodiment thereof when taken in conjunction with the appended drawing wherein:

FIG. 1 is an elevation view, partly in section of the drain clearing bellows of the present invention; and FIG. 2 is a bottom view of FIG. 1.

DETAILED DESCRIPTION

Figure 1:
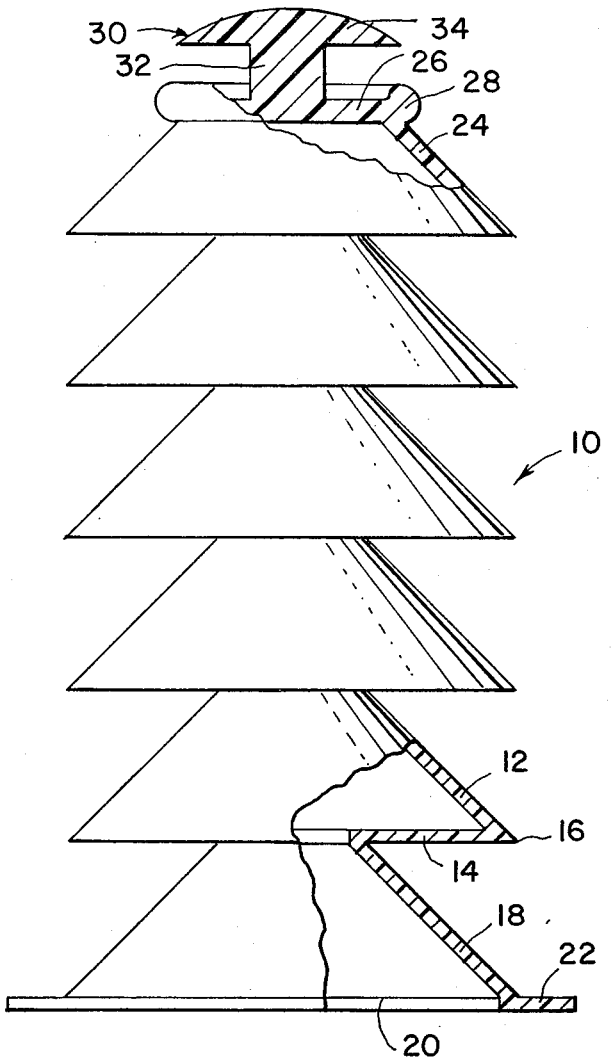
Figure 2:
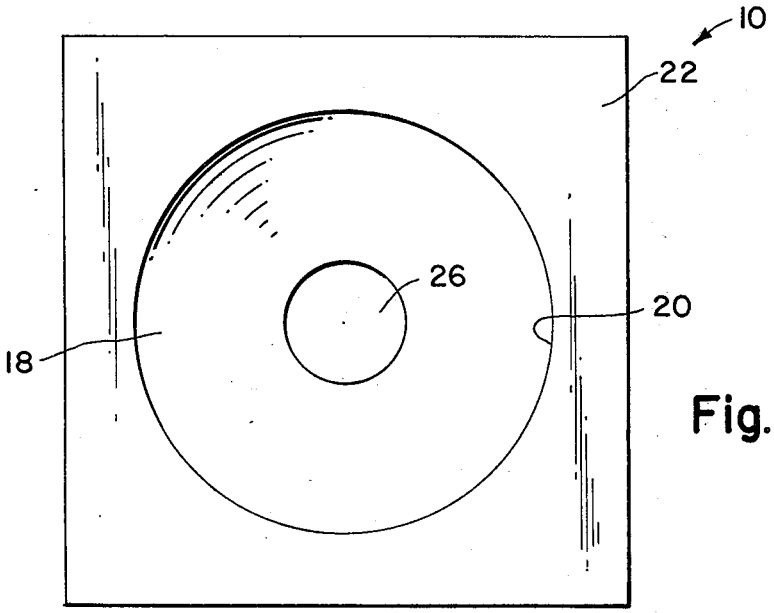

Referring to FIGS. 1 and 2 of the drawing, the drain clearing device 10 of the present invention is preferably a one-piece item molded of rubber or resilient plastic. Device 10 is a substantially tubular elongated thin walled member of generally constant wall thickness which has accordian pleats spaced apart along the length of device 10 for the device to be extensible and collapsable in the longitudinal or vertical direction. The pleats are formed by approximately six coaxial longitudinally spaced frusto-conical wall sections 12 which are serially joined by coaxial annular wall sections 14.

The device 10 has a diameter at the intersection 16 of the large diameter end of each frusto-conical wall section 12, with the outside diameter of annular wall sections 14, which is only slightly larger than the diameter of the usual sink drain opening providing a compact design.

The bottom-most frusto-conical wall section 18 forms at its large diameter end an open mouth 20 for device 10 which includes a transverse flange base 22 for fitting in sealing engagement around the periphery of the usual sink drain opening.

The top-most frusto-conical wall member 24 at its small diameter end is closed by a substantially planar sheet portion 26. Sheet portion 26 is bounded around its circular periphery by a toroidal rim 28 for strengthening purposes.

A mushroom-shaped handle 30, on the order of an inch in length, projects upward from the center of the external side of sheet portion 26. The handle 30 includes a cylindrical stem 32 projecting perpendicular to sheet portion 26 which terminates in a head 34.

When device 10 is placed on top of a sink draining opening, the device functions as a bellows for forcing air under pressure into the drain when a sudden downward force or velocity is applied to head 34, causing the air within the device to be expelled rapidly through mouth 20 and into the drain.

The elongated design of device 10 provides for trapping a large volume of air within the device when extended and for rapidly expelling the air into a drain upon collapsing the device. The handle 30 is configured to enable a proper hand grip for application of a reciprocating vertical motion thereto to enable the device to be used in the nature of a plunger.

The alternating annular walls 14 and frusto-conical walls 12 are provided to maintain the flexible device 10 in coaxial alignment over its length. It should be appreciated by those of ordinary skill in the art that the application of vertical force to head 34 results primarily in the flexing only of annular walls 14 with the frusto-conical wall portions 12 substantially maintaining their shape and consequently maintaining coaxial alignment as the device 10 is collapsed.

The device 10 may be completely collapsed longitudinally to a height of approximately two inches enabling easy storage.

Having described the preferred embodiment of the present invention in detail, it should be appreciated that numerous modifications, additions and omissions in the details thereof are possible within the intended spirit and scope of the invention herein claimed.

What is claimed is:

1. A drain clearing bellows device comprising: an elongated tubular axially compressible resilient member of generally constant wall thickness; said member having a series of pleats along its length formed by coaxial alternating frusto-conical and continuous annular planar wall sections; each frusto-conical wall section having a large diameter end and a small diameter end; the each continuous annular planar wall section having an inner end and an outer end, said inner end being attached to the small diameter end of a frusto-conical wall section and each outer end being attached to the large diameter end of a preceeding frusto-conical wall section; large diameter end of one of said frusto-conical wall sections being at one end of said member and defining a mouth for encompassing a sink drain opening; a planar flange extending integrally and radially from said mouth for sealing around said sink drain opening; an integral closure portion at the opposite end of said member; and a handle integral with said closure portion extending axially therefrom.

* * * * *